US006502269B1

(12) United States Patent
Balchan et al.

(10) Patent No.: US 6,502,269 B1
(45) Date of Patent: Jan. 7, 2003

(54) ELECTRIC POWERED PORTABLE POOL CLEANER

(76) Inventors: John A. Balchan, 26 Pleasant Ave., Lincoln Park, NJ (US) 07035; Jerzy W. Scibiorski, 12 Winant Rd., Kendall Park, NJ (US) 08824

( * ) Notice: Subject to any disclaimer, the term of this patent is extended or adjusted under 35 U.S.C. 154(b) by 266 days.

(21) Appl. No.: 09/685,386

(22) Filed: Oct. 10, 2000

Related U.S. Application Data

(60) Provisional application No. 60/159,486, filed on Oct. 14, 1999.

(51) Int. Cl.[7] ..... E04H 4/16
(52) U.S. Cl. ..... 15/1.7
(58) Field of Search ..... 15/1.7

(56) References Cited

U.S. PATENT DOCUMENTS

| | | | | | |
|---|---|---|---|---|---|
| 3,755,843 | A | * | 9/1973 | Goertzen, III et al. | 15/1.7 |
| 3,822,754 | A | | 7/1974 | Henkin et al. | 180/7.1 |
| 3,886,615 | A | * | 6/1975 | Hayes | 15/17 |
| 3,961,393 | A | | 6/1976 | Pansini | 15/1.7 |
| 4,240,173 | A | | 12/1980 | Sherrill | 15/1.7 |
| 4,275,474 | A | | 6/1981 | Woodard | 15/1.7 |
| 4,651,376 | A | * | 3/1987 | Ford | 15/1.7 |
| 4,835,809 | A | | 6/1989 | Roumagnac | 15/1.7 |
| 4,849,024 | A | | 7/1989 | Supra | 134/21 |
| 4,962,559 | A | | 10/1990 | Schuman | 15/1.7 |
| 5,317,776 | A | | 6/1994 | DeMoura | 15/1.7 |
| 5,450,644 | A | | 9/1995 | Berman | 15/1.7 |
| 5,720,068 | A | | 2/1998 | Clark et al. | 15/1.7 |
| 5,768,734 | A | | 6/1998 | Dietrich | 15/1.7 |
| 5,842,243 | A | * | 12/1998 | Horvath et al. | 15/1.7 |
| 5,930,856 | A | | 8/1999 | Van Der Meyden et al. | 15/1.7 |
| 5,933,899 | A | | 8/1999 | Campbell et al. | 15/1.7 |

FOREIGN PATENT DOCUMENTS

| | | | | |
|---|---|---|---|---|
| AU | 476258 | * | 4/1975 | 15/1.7 |
| FR | 758796 | * | 11/1933 | 15/1.7 |
| FR | 2685374 | * | 6/1993 | 15/1.7 |

* cited by examiner

*Primary Examiner*—Mark Spisich

(57) ABSTRACT

This invention provides a manual, self contained, portable, low voltage electric pool cleaner which draws its power from a surface mounted rechargeable battery. The invention uses pressurized water from a unique pump recirculating system to produce a powerful suction effect necessary for debris removal by an integral filter. All components are submersible except for the power source, which is either handle mounted, or attached to a belt harness worn by the operator. This arrangement precludes the need for external wiring and hoses, thus making the invention a truly portable pool cleaner.

13 Claims, 3 Drawing Sheets

ELECTRIC POWERED PORTABLE POOL CLEANER

CROSS REFERENCES TO RELATED APPLICATIONS

This application claims the benefit of Provisional Patent Application Ser. No. [60/159,486] filed Oct. 14, 1999.

BACKGROUND

1. Field of Invention

This patent application relates generally to the field of swimming pool and spa cleaning apparatus. Specifically, this invention provides an electric powered low voltage portable swimming pool and spa cleaning device, with the power source mounted above the water level.

2. Description of Prior Art

Swimming pool and spa cleaners generally fall into two groups; suction type, and pressure side type. The two groups of pool cleaners can be further categorized by; their means of power (i.e. the pool's filtering system or by independent power), and their means of movement (i.e. automatic or manual).

Suction type pool cleaners rely on the pump intake to provide the necessary suction for lifting the debris off the pool bottom, and then use the pool's filtering system or a separate filter for debris removal. This principle has been used for both manual and automatic suction pool cleaners. Automatic suction cleaners use a portion of suction energy to provide motion by turning turbine wheels, or moving diaphrams to create a random pool cleaning pattern.

Generally, suction type pool cleaners clean slowly and produce relatively low suction effect. Typical examples of suction type pool cleaners are described in U.S. Pat. Nos. 4,275,474; 5,720,068; and 4,849,024.

Suction type pool cleaners that use the pool's filtering system have several drawbacks. They rob power from the pool's circulation system, making the circulation system less efficient. The debris that is collected in the pool's filtering system causes frequent filter changes, and cleaning. This could lead to failure of the main pump of the pool's filtering system. Suction type cleaners are not effective for removal of heavy debris, such as pebbles, and sand. Setup for operation requires the use of bulky hoses to attach to the pool cleaner head, and the pool's circulation system. This hose must then be disconnected and removed from the pool when cleaning is complete.

Attempts have been made to eliminate the use of the pool circulation system and the need for external connections for suction type pool cleaners. One such system, shown in U.S. Pat. No. 4,962,559, and U.S. Pat. No. 5,111,129, is a self contained suction type pool cleaner that utilizes a submersible pump and battery to produce a self contained cordless suction type pool cleaner. This pool cleaner includes a submersible container which defines a sealed water chamber and a filter chamber. The filter chamber has a water inlet port to it and a water discharge opening from it to the exterior of the container. A filter and pump impeller are mounted in the filter chamber. An electric motor is mounted in the motor chamber and has a motor shaft which extends through a liquid seal to the filter chamber where it carries the pump impeller. The pump impeller is used to draw water through the filter and out the discharge opening in the filter chamber. Entrained pool debris in the water flowing through the cleaner is retained by the filter. While this cleaner precludes the need of the pool circulation system and external connections, certain shortcomings have been observed. Being a suction type cleaner, suction effect is weak. Suction efficiency is further compromised by the low power of the single impeller pump placed after the filter. As the filter becomes clogged, suction effect further drops off rapidly. Also, water contamination problems will occur if there is a leak in the battery.

The manual self contained suction type cleaner as described in U.S. Pat. No. 5,450,644 uses a submersible pump and battery with the filter located at the pump outlet. The drawback with this design is obvious in that the pump is subject to malfunction due to clogging of entrained debris flowing with the water through the pump to the filter.

The suction type pool cleaners described in U.S. Pat. Nos. 5,768,734, and 5,3.17,776 are essentially the same as the previously described art with the difference being the pump is AC electric powered. This has the added disadvantage from the previously described prior art in that there is the inconvenience of an external electric connection along with the safety hazards of an AC electric powered device submerged in pool water.

Pressure side pool cleaners utilize water pressure to create an eductive force which in turn produces a suction effect for lifting debris off the pool bottom. Typical examples of this type of cleaner are described in U.S. Pat. Nos. 3,961,393, and 4,240,173. These pool cleaners use an external connection to the outlet of the pool's circulation system to produce the pressure required for suction effect. Other types of pressure side pool cleaners use a pressure source other than the pool's circulation system. (e.g. another pump or an ordinary garden hose ). These pressure side pool cleaners use a separate pump and motor, either surface mounted or submerged for producing suction effect, and in the case of automatic pool cleaners, use this same pump to provide motion. Typical examples of these pressure side pool cleaners are described in U.S. Pat. Nos. 5,933,899, 5,930,856, 4,835,809 and 3,822,754. All of the pressure side cleaners have a separate filter for retaining debris.

Pressure side pool cleaners generally provide a stronger suction effect than suction type cleaners. Therefore, it is believed to be more efficient, and can clean faster than a suction type pool cleaner. Since they use separate filters, they do not clog the pool's filtering system.

Although perceived as a better pool cleaner, current pressure type pool cleaners have their drawbacks as well. Manual and some automatic pressure pool cleaners require the use of cumbersome external connections to be mounted to the pump if it is surface mounted. Also, some submersible automatic pool cleaners require the placement of AC electric wires to be placed in the water for operation. The cleaning patterns of all automatic pressure side pool cleaners are random, thereby making the pool cleaning operation relatively slow and inefficient.

Accordingly, a need exists for a pressure side pool cleaner with a strong suction effect, being self contained which precludes the need for external connections, maintains cleaning efficiency by using a filter dowmstream of the pump and can be maneuvered by the operator to clean only the submerged pool surfaces that contain debris. The present invention fulfills these and other needs.

OBJECTS AND ADVANTAGES

It is a main object of this invention to selectively clean the bottom surface and sides of any size, and type swimming pool, spa, fountain, or small pond with a self contained pressure side pool cleaner using a safe power source which is located above the water surface.

It is another objective of this invention to employ a unique pressure side eduction system that will produce a suction effect capable of lifting pebbles, sand, and other large and heavy pool debris.

It is another objective of this invention to provide a power source that is portable and rechargeable.

The present invention accomplishes this strong suction effect by recovering a portion of the kinetic energy generated by the pressurized water stream that is used to produce the suction effect. This recirculated water stream is filtered before entering the pump inlet.

The present invention overcomes all of the limitations of the prior art by providing a compact self contained low voltage electric powered cleaner, capable of cleaning irregular shaped underwater surfaces of pools and spas.

The invention includes the following main parts; a pump, pump chamber, a nozzle chamber, suction chamber, filter, and telescoping handle. The suction chamber provides the water intake, and houses an underwater light for improved vision. The pump chamber houses a multiple stage fully submersible pump and motor. The nozzle chamber houses a pressure nozzle, and suction nozzle. A series of conduit provide passage for water circulation, from the pump to the nozzle chamber to the filter and back to the pump intake. The telescoping handle provides the means for movement of the cleaner from above the surface of the water. The low voltage rechargeable battery pack mounts either on the telescoping handle, or can be mounted on a harness worn by the cleaner operator.

Still further objects and advantages will become apparent from a consideration of the ensuing description and accompanying drawings.

SUMMARY

These and other objects are achieved by an electric self contained portable pressure side pool cleaner that has a surface mounted power source, a unique pump recirculating system that produces a powerful suction effect for removing heavy debris off the pool bottom.

Specifically, the cleaner is comprised of:

(a) a pump submerged into vessel liquid converting the electrical energy into kinetic energy of the first stream of liquid which is segregated from the vessel liquid by a system of chambers and conduits.

(b) system of chambers and conduits changing a portion of the kinetic energy of said first stream of liquid into potential energy to induce the flow of the second stream of vessel liquid with entrained debris and mixing both streams into combined third stream.

(c) filters for selectively separating the debris from the liquid of the third stream and returning debris-free liquid to the vessel, and back to the pump.

(d) motion system to provide cleaning of all areas of the vessel.

Preferred Embodiment—Description

Figure 1:
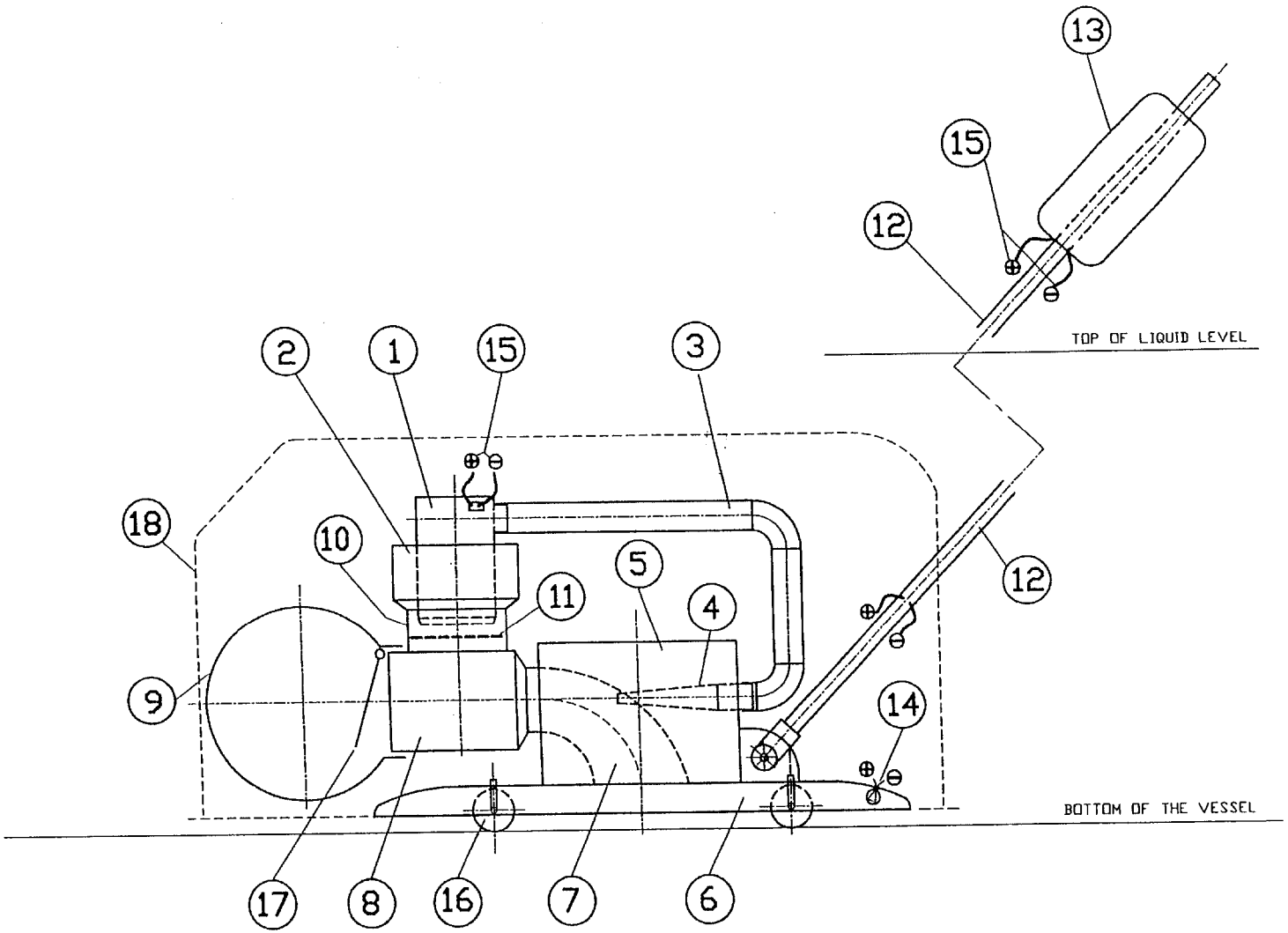
FIG. 1 is an overall perspective view of the invention.
Figure 3:
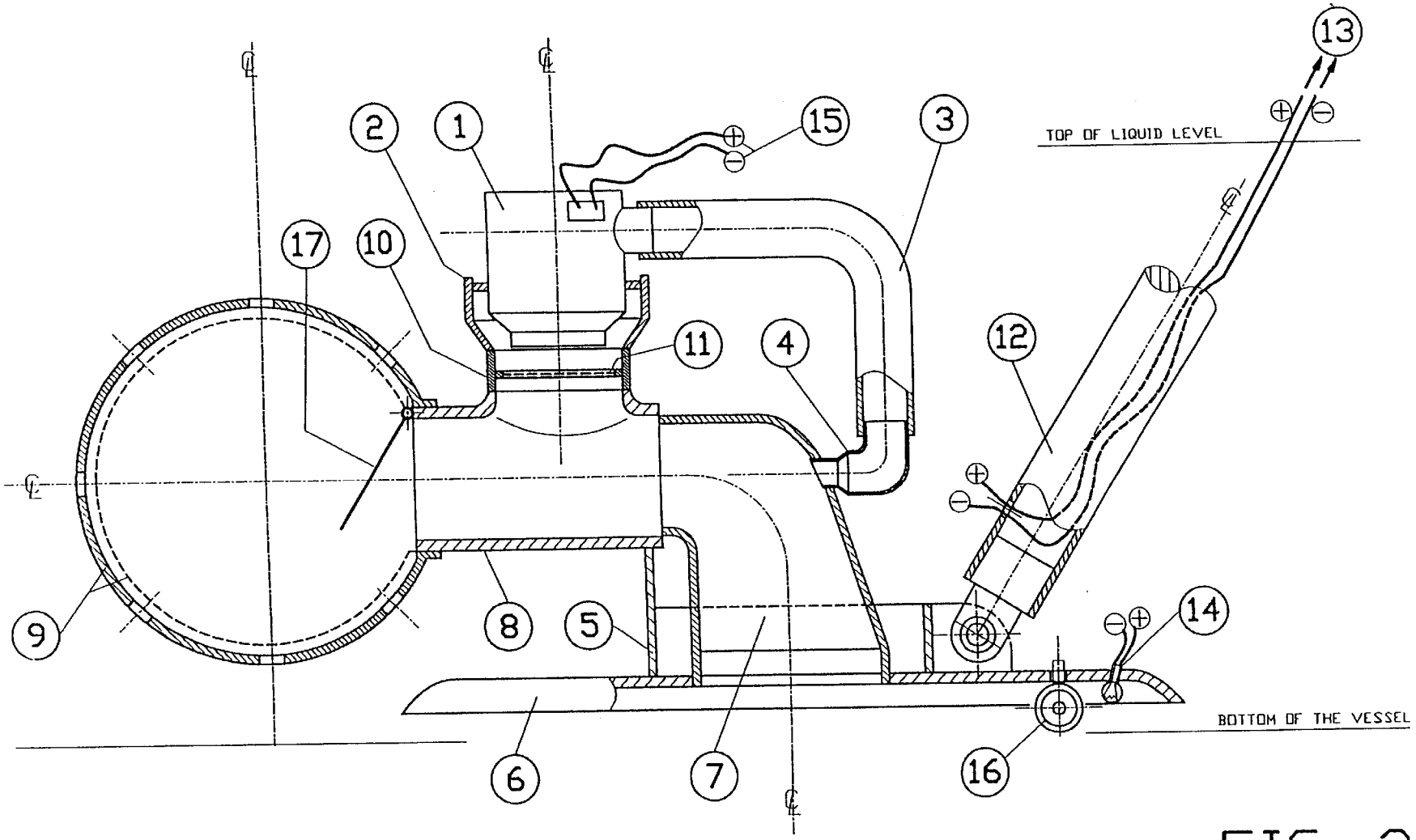
FIG. 3 is a sectional view of the principle assembly.

Referring to FIGS. 1, and 3, the invention is a pool cleaner comprised of the following major parts; a pump (1) with a sealed electrical motor, a pump chamber (2), a suction chamber (6), a nozzle chamber (5), a filter (9), a telescoping handle (12), and a plurality of conduits communicating with the chambers in order to define a flow path of water through the cleaner. A suction nozzle (7) has its lower end communicating with the suction chamber, and its upper end communicating with the side opening of the nozzle chamber. The pressure nozzle (4) has a smaller end penetrating the side of the suction nozzle. The first conduit section (3) communicates between the pump outlet, and the larger end of the pressure nozzle. The second conduit (8) connects the smaller end of the suction nozzle to the filter. A check valve (17) is located at the filter end of the second conduit. A third conduit (10) is connected to the top opening of the second conduit and the inlet of the pump chamber. A filter screen (11) is mounted in the third conduit at the top opening of the second conduit. A rechargeable battery with switch and indicator light (13) is mounted at the top operating end of the telescoping handle. A water-tight low voltage electric light (14) is mounted on top of the suction chamber. Electrical wiring (15) electrically connects the pump motor and light to the battery. Pivoting wheels(1 6) are attached to the bottom of the suction chamber to provide support and movement for the invention. Tubular "sleds" mounted on the bottom rim of the suction chamber may be used in place of the pivoting wheels.

As seen in FIGS. 1 and 3, the pump and motor are submersible and attached to the pump chamber with a mounting plate. The motor is contained in a water-tight chamber with the shaft extending through a water-tight seal to the pump impeller. The pump chamber is a vertical cylinder with a bottom opening and a top plate. The top plate opening is for the pump outlet and the bottom opening is for the pump intake. The suction nozzle is mounted inside the nozzle chamber. The pressure nozzle penetrates the suction nozzle horizontally at the tangent of the suction nozzle. The suction chamber is a vertical converging open cylinder with its top and smaller end communicating with the bottom end of the nozzle chamber, and its bottom and larger end facing the pool bottom. The wheels provide an adjustable clearance between the suction chamber and pool bottom.

The first conduit is made of a flexible material and connects the pump outlet to the large end of the pressure nozzle. The second conduit made of a rigid plastic material attaches at one end to the smaller end of the suction nozzle. The second conduit diameter is then increased whereby it connects at the other end to the filter. The filter contains disposable elements and utilizes a quick disconnect coupling for attachment to the second conduit. At its midpoint, the second conduit has a top opening. In this top opening, a screen, made of plastic, is inserted in a horizontal plane. The third conduit, made of a rigid material, attaches at one end to the top opening of the second conduit, and to a coupling located at the intake end of the pump chamber. The screen, located in the top end of the second conduit is a perforated horizontal plate made from plastic. A quick disconnect fitting allows removal of screen for periodic cleaning. The submerged end of the telescoping handle attaches pivotally to the suction chamber. This provides the optimum balance for movement of the invention along the pool bottom. The light is attached to the top end of the suction chamber with a bracket, and is located 180 degrees opposite the telescoping handle attachment. As best viewed in FIG. 1, the operating end of the telescoping handle projects above the water level. The battery is attached to this end of the telescoping handle. An alternate battery can be attached to a harness worn by the operator. The electrical wiring, designed for low voltage DC electric power, and waterproof, is routed through the pump chamber, up through and inside the telescoping handle, and to connections located at the battery switch at the top end of the telescoping handle.

The three chambers and conduit can be produced as one integral unit, and made from a material such as plastic.

It is understood that while certain forms of the invention have been illustrated and described herein, it is not limited to the specific forms or arrangements of parts described herein.

Preferred Embodiment—Operation

In operation, the invention is used to clean any in-ground or above-ground pool. The invention also can be used in other water containing vessels that require periodic cleaning. When the chamber sections(2),(5),(6) are submerged in the pool or vessel, they are designed to immediately "flood" with water. The battery switch (13) located on the operating end of the telescoping handle(12) is then turned on, the pump (1) starts to circulate water through the pump, first conduit (3), pressure nozzle (4), suction nozzle (6), and the second conduit (8). An indicator light at the battery switch alerts the operator that the cleaner is in operating mode .

Figure 2:
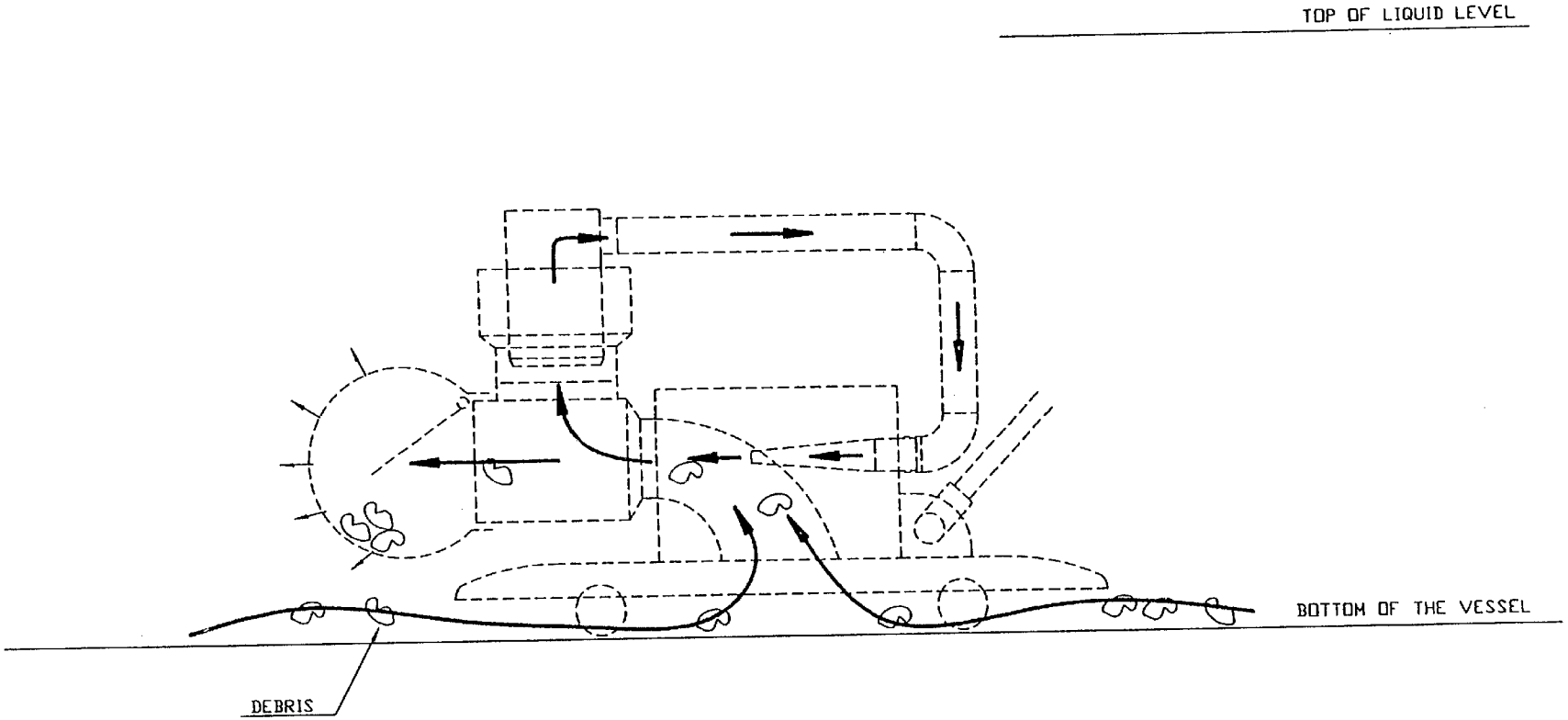
FIG. 2 is a schematic of the fluid flow circuit in the invention.

The jet effect caused by the pumped water leaving the pressure nozzle entrains water entering the suction chamber from the pool bottom. This combined water flow creates a powerful suction action which lifts debris off the pool bottom. The debris then flows (with the water) into the suction chamber, through the suction nozzle where it combines with the water from the pressure nozzle, and continues into the second conduit. At the second conduit, water flow "splits" with the portion of the water stream carrying the entrained debris flowing to the filter (9), while the other portion of the water stream flows back to the pump via the third conduit (10). The screen (11) in the third conduit controls debris flow to the filter where it is collected and retained. By recirculating water to the pump, energy is recovered in the circulating water stream which prolongs battery life, and enhances pump output to produce the strong suction effect at the inlet to the suction chamber. Water flow to the filter passes through a permeable material and returns to the pool while the entrained debris is retained in the filter (FIG. 2).

The telescoping handle being hinged at the point of attachment on the suction chamber is used preferrably outside the pool to maneuver the invention along the pool bottom. The telescoping handle can be adjusted to allow for maneuvering the invention at various pool depths. Pivoting wheels (16), extending from the bottom of the suction chamber, provide support, and allow movement of the invention along the pool bottom. Tubular "sleds" attached around the bottom rim of the suction chamber also may be used for movement of the invention along the pool bottom. The use of sleds and wheels together allow the suction chamber close contact with the pool bottom, thus providing improved suction effect for heavy pool debris.

A rechargeable battery(13) or other low voltage power source provides the electric power for the pump operation. The battery and switch for pump operation is attached to the telescoping handle. A harness worn by the operator may also be used to carry the battery during operation. The battery allows the invention to be completely self contained, requiring no external wiring or hoses for operation. The invention can be equipped with a light bulb(14) to allow for evening operation, or to enhance cleaning in dark or murky water.

When the cleaning operation is complete, the operator turns the switch to the off position, and hence stops water flow and suction action. The indicator light at the battery switch turns off to alert the operator that the cleaner is not in operating mode. The check valve is designed to retain the debris when the water flow action is stopped. The filter is uncoupled from the second conduit. The debris is then removed from the filter. As required, the battery can be re-charged for the next cleaning operation.

Conclusions, Ramifications, and Scope

Accordingly, it can be seen that this invention will provide a unique, and viable alternative to fulfill a need for a self contained, portable self powered pool cleaning device, requiring no external wiring or hoses for operation.

Although the description above contains many specificities, these should not be construed as limiting the scope of the invention but as merely providing illustrations of some of the presently preferred embodiments of this invention. Various other embodiments and ramifications are possible within its scope. For example, The invention can take on various shapes, colors, different arrangements of the main parts, and be manufactured from different materials. The battery pack can be specified with various voltage supply (e.g. 24VDC vs 12VDC). Also, the invention can be modified for automatic operation.

Thus, the scope of this invention should be determined by the appended claims and their legal equivalents, rather than by the examples given.

What is claimed is:

1. A portable, self-contained pool cleaner comprising:

a) a suction chamber adapted to be placed adjacent to and moved along a submerged surface, said suction chamber converging from a bottom opening to a top opening thereof;

b) an elongated handle having a first end thereof pivotally connected to the suction chamber for manually manipulating the cleaner by grasping an operating end thereof from above the surface of the water in the pool;

c) a tubular, converging suction nozzle having a smaller end and a larger end in fluid communication with the top opening of said suction chamber, said suction nozzle being curved between the smaller and larger ends thereof;

d) a nozzle chamber in which said suction nozzle is enclosed;

e) a converging pressure nozzle within said nozzle chamber having opposed large and small ends, the small end of the pressure nozzle extending into the suction nozzle;

f) a pump chamber having an inlet and an outlet;

g) a submersible electric motor and pump associated with said pump chamber;

h) a first conduit coupled between the pump outlet and the large end of the pressure nozzle;

i) a filter;

j) a second conduit coupled between the smaller end of the suction nozzle and the filter, said second conduit further including a side opening;

k) a third conduit coupled between the side opening of the second conduit and the pump inlet;

l) a screen between the suction nozzle and the pump inlet for controlling debris flow to the filter; and m) a power source for said electric pump motor.

2. The pool cleaner of claim 1 wherein said pump is a multi stage pump system.

3. The pool cleaner of claim 1 wherein said power source is low voltage DC electricity.

4. The pool cleaner of claim 3 wherein said low voltage DC electricity source is a rechargeable battery and a switch mounted at the operating end of the said handle.

5. The pool cleaner of claim 3 wherein said low voltage DC electricity source is a rechargeable battery and a switch mounted on harness worn by the operator above the water level.

6. The pool cleaner of claim 1 wherein said filter is a disposable filter element.

7. The pool cleaner of claim 1 wherein said filter is irregular in shape and made of permeable material.

8. The pool cleaner of claim 1 wherein said suction chamber has adjustable openings.

9. The pool cleaner of claim 1, further including means of supporting the entire cleaner.

10. The pool cleaner of claim 9 wherein said means of support are plastic wheels mounted to a bottom edge of said suction chamber.

11. The pool cleaner of claim 9 wherein said means of support are sleds of open tubular conduit mounted to a bottom edge of said suction chamber.

12. The pool cleaner of claim 1 wherein said pump chamber, said nozzle chamber, said suction chamber, said suction nozzle, said pressure nozzle, said first conduit, said filter and said second conduit are made of plastic.

13. The pool cleaner of claim 1, further including a waterproof bulb lamp powered by the same source of electricity that powers said pump.

* * * * *